US009261841B2

(12) United States Patent
Fujikura et al.

(10) Patent No.: US 9,261,841 B2
(45) Date of Patent: Feb. 16, 2016

(54) IMAGE FORMING APPARATUS

(71) Applicant: Konica Minolta, Inc., Tokyo (JP)

(72) Inventors: Teruhiko Fujikura, Aichi (JP); Satoshi Miyajima, Tokyo (JP); Tadayuki Ueda, Tokyo (JP); Yoshihito Sasamoto, Tokyo (JP); Eiji Nishikawa, Tokyo (JP); Takanobu Shiki, Tokyo (JP); Akinori Kimata, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/162,089

(22) Filed: Jan. 23, 2014

(65) Prior Publication Data

US 2014/0212185 A1 Jul. 31, 2014

(30) Foreign Application Priority Data

Jan. 29, 2013 (JP) ..... 2013-014388

(51) Int. Cl.
*G03G 15/01* (2006.01)
*G03G 15/00* (2006.01)

(52) U.S. Cl.
CPC ..... *G03G 15/5058* (2013.01); *G03G 15/0189* (2013.01); *G03G 2215/0132* (2013.01); *G03G 2215/0161* (2013.01)

(58) Field of Classification Search
CPC ..... G03G 2215/0158–2215/0161
USPC ..... 399/301
See application file for complete search history.

(56) References Cited

U.S. PATENT DOCUMENTS 6,644,773 B2 * 11/2003 Bildstein et al. ..... 347/19
6,975,414 B2 12/2005 Nagatomi et al.
7,075,561 B2 * 7/2006 Ozawa et al. ..... 347/116

(Continued)

FOREIGN PATENT DOCUMENTS

JP 01 269958 A 10/1989
JP 2002-072603 3/2002

(Continued)

OTHER PUBLICATIONS

English machine translation of Nakazato (JP2005202110, cited by applicant, published Jul. 28, 2005).*

(Continued)

*Primary Examiner* — Clayton E Laballe
*Assistant Examiner* — Leon W Rhodes, Jr.
(74) *Attorney, Agent, or Firm* — Lucas & Mercanti, LLP

(57) ABSTRACT

An image forming apparatus forms decision registration mark for deciding whether or not a color registration correction for correcting color shifts in the color image carries out on an intermediate transfer belt. The decision registration mark is formed by registering four color registration marks. Color registration sensors detect a detection width of the decision registration mark along a sub scanning direction. A control portion receives the detection width of the decision registration mark and decides whether or not the color registration correction carries out based on whether or not the detection width of the decision mark detected by the detection portion exceeds the period of reference time. When the detection width of the decision mark detected by the detection portion exceeds the period of reference time, the control portion carries out the color registration correction.

9 Claims, 9 Drawing Sheets

(56) References Cited

U.S. PATENT DOCUMENTS

| | | | | |
|---|---|---|---|---|
| 7,239,833 | B2 * | 7/2007 | Tomita et al. | 399/299 |
| 7,706,705 | B2 | 4/2010 | Tomita et al. | |
| 8,004,546 | B2 | 8/2011 | Miyadera | |
| 8,059,145 | B2 | 11/2011 | Ueda et al. | |
| 8,867,973 | B2 * | 10/2014 | Masui | 399/301 |
| 2008/0174834 | A1 * | 7/2008 | Ueda | G03G 15/01 358/488 |
| 2009/0003893 | A1 * | 1/2009 | Nishikawa et al. | 399/301 |
| 2011/0007120 | A1 * | 1/2011 | Motoi et al. | 347/116 |

FOREIGN PATENT DOCUMENTS

| | | |
|---|---|---|
| JP | 2005-165220 | 6/2005 |
| JP | 2005-172945 | 6/2005 |
| JP | 2005-202110 | 7/2005 |
| JP | 2008-139436 | 6/2008 |
| JP | 2008-203833 | 9/2008 |
| JP | 2009-205147 | 9/2009 |

OTHER PUBLICATIONS

Office Action dated Mar. 3, 2015 from the corresponding Japanese patent application No. 2013-014388 (4 pages).

English translation of Office Action dated Mar. 3, 2015 from the corresponding Japanese patent application No. 2013-014388 (4 pages).

* cited by examiner

RELATED ART

TB1

| RANGE OF REFERENCE VARIATION AMOUNT (SLOPE) | FREQUENCY OF FORMING DECISION REGISTRATION MARKS |
|---|---|
| $0 \leqq a < a1$ | ONE TIME PER 100 SHEETS |
| $a1 \leqq a < a2$ | ONE TIME PER 50 SHEETS |
| $a2 \leqq a < a3$ | ONE TIME PER 20 SHEETS |
| $a3 \leqq a < a4$ | ONE TIME PER 10 SHEETS |
| $a \leqq a4$ | EVERY TIME (ONE TIME PER EACH SHEET) |

TB2

| RANGE OF SUB REFERENCE DETECTION WIDTH | FREQUENCY OF FORMING DECISION REGISTRATION MARKS |
|---|---|
| T11≦T<T1a | ONE TIME PER 100 SHEETS |
| T1a≦T<T1b | ONE TIME PER 50 SHEETS |
| T1b≦T<T1c | EVERY TIME (ONE TIME PER EACH SHEET) |

IMAGE FORMING APPARATUS

CROSS REFERENCE TO RELATED APPLICATION

The present invention contains subject matter related to Japanese Patent Application No. JP 2013-014388 filed in the Japanese Patent Office on Jan. 29, 2013, the entire contents of which being incorporated herein by reference.

BACKGROUND OF THE INVENTION

1. Technical Field

The present invention relates to an image forming apparatus such as a color printer, a color copier and the like.

2. Background Art

In a recent image forming apparatus, there may be a case where any color shifts occur when registering respective color toner images. This is because a diameter of a driving roller of an intermediate transfer belt varies due to temperature rise inside the image forming apparatus during image forming operation and a speed of the intermediate transfer belt chronologically changes. The image forming apparatus has carried out a color registration correction on a regular basis in order to correct the color shifts.

FIGS. 1A and 1B show a general color registration correction. In the color registration correction, at timing other than any printing operation, for example, at power on, four species of color registration marks 120K, 120C, 120M and 120Y are formed on the intermediate transfer belt 800, as shown in FIG. 1A. Color registration sensors 210, 212 respectively detect positions of four species of color registration marks 120K, 120C, 120M and 120Y formed on the intermediate transfer belt 800 and amounts of color shifts in respective colors are calculated.

For example, as shown in FIG. 1B, when detecting the amounts of color shifts along a main scanning direction, a sensor detects two edges of the color registration mark 120Ka so that a period of detection time Ta therebetween is calculated. The amounts of color shifts in the respective colors along the main scanning direction are calculated by comparing this period of detection time Ta with a period of reference time thereof. When detecting the amounts of color shifts along a sub scanning direction, the sensor detects two edges of the color registration marks 120Ka and 120Kb so that a period of detection time Tb therebetween is calculated. The amounts of color shifts in the respective colors along the sub scanning direction are calculated by comparing the period of detection time Tb with a period of reference time thereof.

Japanese Patent Application Publication No. H01-269958 discloses an image forming apparatus in which a color registration sensor reads respective color registration marks that are independently formed between pages (image forming regions) on the transfer belt and a color shift correction starts from each read color registration mark.

SUMMARY OF THE INVENTION

Issues to be Addressed by the Invention

The image forming apparatus disclosed in Japanese Patent Application Publication No. H01-269958 has performed a color registration correction between pages. In such a color registration correction, by taking into consideration any variation in a cycle of photosensitive drum and/or a cycle of belt, the color registration marks are formed while an interval between the sheets of paper lengthens as compared with an interval between the sheets of paper during normal printing time. This causes less numbers of sheets of paper that are printable within a fixed time so that its print efficiency deteriorates.

The color registration correction carries out at timing of temperature rise around a process or at timing when predetermined sheets of paper pass through the apparatus. When any previously carried out jobs heat the apparatus (or in a condition where the apparatus is not cool), the inside of the apparatus keeps high to a certain extent. When the apparatus starts in this state and the registration correction carries out at timing of temperature rise, there may be a case where the apparatus does not shift to any color registration correction even if color shifts occur because of the high temperature in the apparatus. On the other hand, when the temperature in the apparatus reaches a fixed temperature, there may be a case where the apparatus carries out the color registration correction even if no color shifts occur actually. This causes any print efficiency to deteriorate and any toners to be wasted.

In a case of carrying the color registration correction out at timing when a predetermined sheets of paper passes through the apparatus, there may be a case where when the passed sheets of paper reaches the predetermined sheets of paper, the apparatus does not shift to any color registration correction even if color shifts occur. On the other hand, before the passed sheets of paper reaches the predetermined sheets of paper, there may be a case where the apparatus carries out the color registration correction even if no color shifts occur.

Means for Solving the Problem

This invention addresses the above-mentioned issues and has an object to provide an image forming apparatus that can carry out a color registration correction efficiently.

To achieve the above-mentioned object, an image forming apparatus reflecting one aspect of this invention, which forms a color image by transferring images of respective colors formed on photosensitive members to an intermediate transfer member, contains an image forming portion that forms a decision mark for deciding whether or not a color registration correction for correcting color shifts in the color image carries out, the decision mark being obtained by registering the respective color marks on the intermediate transfer member, a detection portion that detects a width of the decision mark formed on the intermediate transfer member by the image forming portion, and a control portion that is configured to decide whether or not the color registration correction carries out based on the width of the decision mark detected by the detection portion.

According to the image forming apparatus reflecting one aspect of this invention, the image forming portion forms the decision mark by registering respective color marks on the intermediate transfer member. The detection portion detects the width of the decision mark formed on the intermediate transfer member. Based on the detection results by the detection portion, the control portion decides whether or not the color registration correction carries out.

In the image forming apparatus reflecting one aspect of this invention, the color mark constituting the decision mark contains color registration marks of respective colors such as yellow, magenta, cyan, black and the like, which are used in the color registration correction. The width of the decision mark means that a period of detection time taken between edges of the decision mark along a width direction thereof. The intermediate transfer member contains an intermediate transfer belt, drum and the like.

It is desirable to provide the image forming apparatus wherein the control portion controls the image forming portion to set writing timings of the respective color marks so that the decision mark is formed on the intermediate transfer member between sheets of paper.

It is also desirable to provide the image forming apparatus wherein timing of forming the decision mark is optionally changed.

It is still desirable to provide the image forming apparatus wherein the image forming portion contains plural photosensitive members corresponding to the respective colors, and the control portion controls the image forming portion to form the decision mark on the intermediate transfer member by using two photosensitive members which are set on positions that are farthest from each other among the plural photosensitive members.

It is further desirable to provide the image forming apparatus wherein the control portion controls the image forming portion to form the decision mark on the intermediate transfer member during a printing operation in a job, and when it is decided that the color shifts occur in the decision mark, the control portion controls the image forming portion to stop the printing operation in the job and start the color registration correction.

It is additionally desirable to provide the image forming apparatus wherein the control portion controls the image forming portion to change timing of forming the decision mark based on a variation amount in the widths of respective decision marks formed on the intermediate transfer member by plural times.

It is still further desirable to provide the image forming apparatus wherein the control portion controls the image forming portion to change timing of forming the decision mark based on a length of a width of the decision mark detected by the detection portion.

It is still additionally desirable to provide the image forming apparatus wherein the control portion is configured to decide whether or not the color registration correction carries out by using a reference width of the decision mark that is a reference when the color shifts occur in the color image and the reference width is optionally changed.

It is still desirable to provide the image forming apparatus wherein the control portion controls the image forming portion to set writing timing of the respective color marks so that the decision mark is formed on the intermediate transfer member between jobs.

It is still desirable to provide the image forming apparatus wherein the control portion calculates an average value of the widths of respective decision marks formed on the intermediate transfer member by plural times and is configured to decide whether or not the color registration correction carries out based on the calculated average value.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe configuration examples of the image forming apparatus as preferred embodiments relating to the invention with reference to drawings. It is to be noted that the description in the embodiments is exemplified and any technical scope of the claims and/or meaning of term(s) claimed in the claims are not limited thereto.

First Embodiment

Figure 1A:
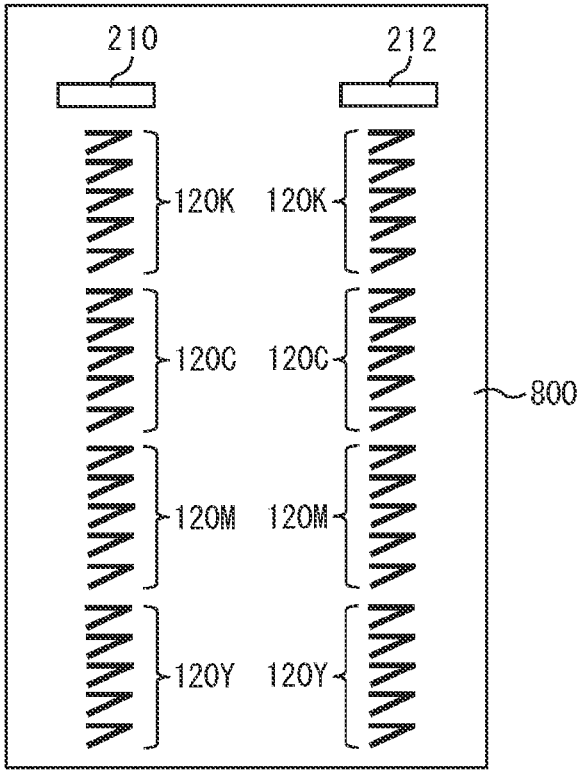
FIGS. 1A and 1B are diagrams showing a general color registration correction.
Figure 1B:
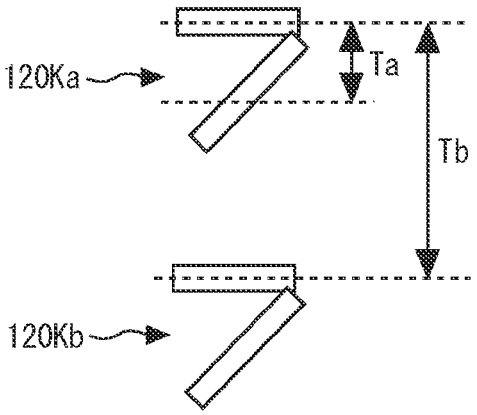
RELATED ART FIG. 1B
Figure 2:
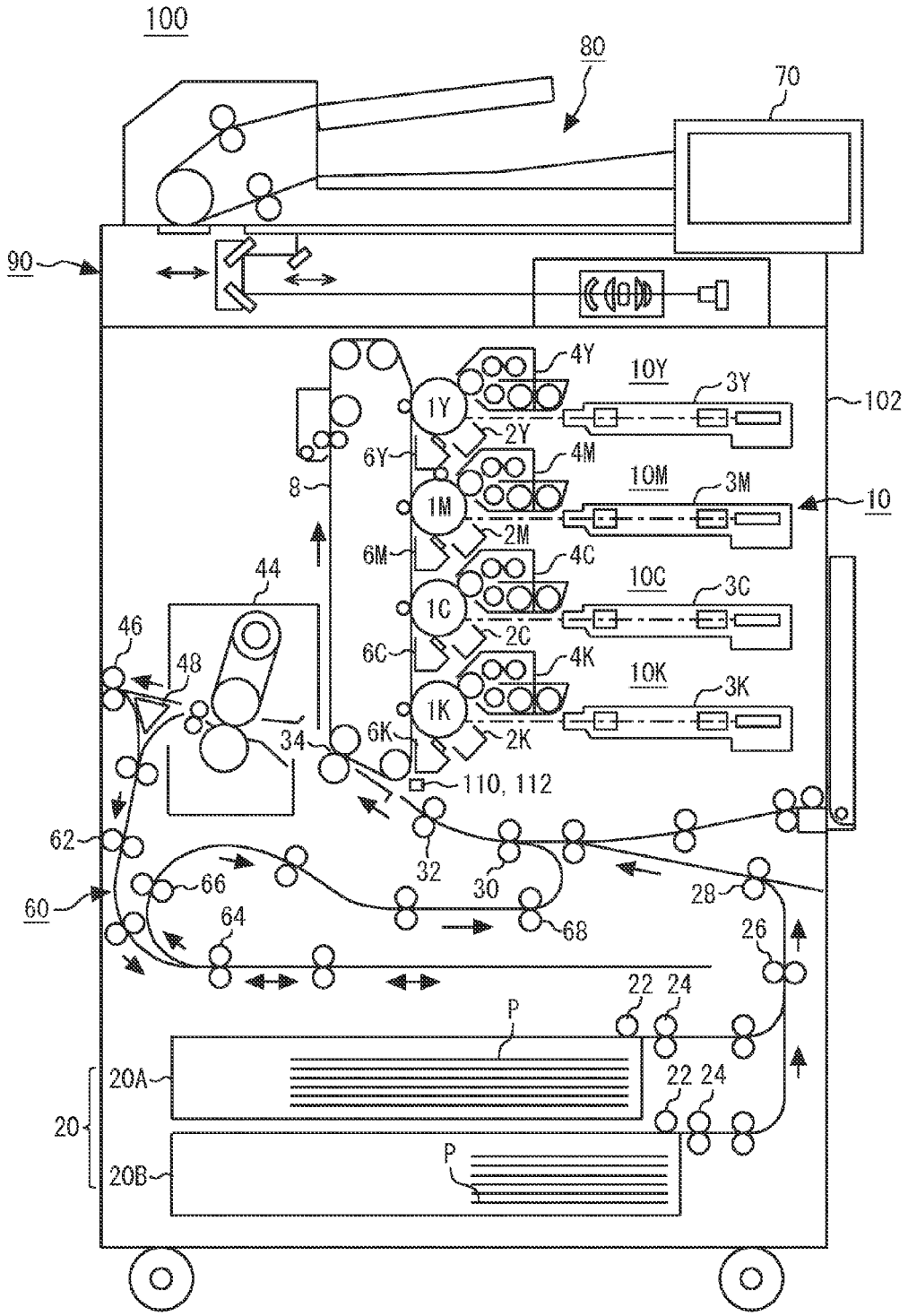
FIG. 2 is a diagram showing a configuration example of an image forming apparatus according to a first embodiment of the invention.

FIG. 2 shows a configuration example of an image forming apparatus 100 according to a first embodiment of the invention. It is to be noted that ratios and dimensions in drawings are shown in an exaggerated way for convenience of explanation and the ratios may be different from real ones. In the following description, a main scanning direction D1 will be a direction in which laser light is scanned against a photosensitive drum or the like and a sub scanning direction D2 will be a direction that is perpendicular to the this main scanning direction.

The image forming apparatus 100 according to the invention forms on an intermediate transfer belt 8 a decision color registration mark 12U for deciding whether or not the color registration correction carries out before the color registration correction carries out. The image forming apparatus 100 decides whether or not the color registration correction carries out based on a detection width of the decision color registration mark 12U (a color shift amount). This enables its print efficiency to be improved. The decision color registration mark 12U is formed by registering four color registration marks 12Y, 12M, 12C and 12K, which will be described later.

As shown in FIG. 2, the image forming apparatus 100 is an image forming apparatus called as "tandem type image forming apparatus". The image forming apparatus 100 contains an automatic document feeding portion 80 and an apparatus main body 102. The apparatus main body 102 mounts the automatic document feeding portion 80. The automatic document feeding portion 80 feeds a document set on a document table to an image reading portion 90 of the apparatus main body 102 using conveying rollers and the like.

The apparatus main body 102 contains a manipulation/display portion 70, the image reading portion 90, an image forming portion 10, an intermediate transfer belt 8, which is an example of the intermediate transfer member, color registration sensors 110, 112, a fixing portion 44 and an auto duplex unit (ADU).

The manipulation/display portion 70 contains a touch panel in which a display unit made of liquid crystal or the like and a positional detection unit of pressure-sensitive resistance film type or electrostatic capacitance type are combined, and key buttons such as ten keys, a start key and the like, which are provided around the touch panel. The manipulation/display portion 70 displays a manipulation screen and receives setting of image forming conditions such as a size and/or a species of a sheet of paper input by a user through the manipulation screen.

The image reading portion 90 scans and exposes the document mounted on the document table using an optical system in a scanning and exposure device. The image reading portion 90 performs photoelectric conversion on a scanned image of the document by a charge-couple device (CCD) image sensor to obtain an image information signal. The image reading portion 90 then performs a predetermined processing on this image information signal and outputs it to the image forming portion 10.

The image forming portion 10 forms an image based on an electrophotographic method. The image forming portion 10 includes an image forming unit 10Y which forms a yellow (Y) image, an image forming unit 10M which forms a magenta (M) image, an image forming unit 10C which forms a cyan (C) image and an image forming unit 10K which forms a black (K) image. The image forming units 10Y, 10M, 10C and 10K are arranged in a line from an upstream (upper) side in order along a moving direction of the intermediate transfer belt 8. In this embodiment, in order to indicate a color relative to common function or name, Y, M, C or K will be attached to the number of the common function or name, for example, 10Y.

The image forming unit 10Y includes a photosensitive drum 1Y, a charging portion 2Y arranged around the photosensitive drum 1Y, a writing (exposure) portion 3Y, a developing portion 4Y and a cleaning portion 6Y. The image forming unit 10M includes a photosensitive drum 1M, a charging portion 2M arranged around the photosensitive drum 1M, a writing portion 3M, a developing portion 4M and a cleaning portion 6M. The image forming unit 10C includes a photosensitive drum 1C, a charging portion 2C arranged around the photosensitive drum 1C, a writing (exposure) portion 3C, a developing portion 4C and a cleaning portion 6C. The image forming unit 10K includes a photosensitive drum 1K, a charging portion 2K arranged around the photosensitive drum 1K, a writing portion 3K, a developing portion 4K and a cleaning portion 6K.

Since the image forming units 10Y, 10M, 10C and 10K of respective colors have the same configuration as each other, the description on the configuration of the image forming units other than the image forming unit 10Y will be omitted in the following description. The charging portion 2Y uniformly charges static charges around a surface of the photosensitive drum 1Y. The writing portion 3Y contains LED print head (LPH) including LED array and an image formation lens, and a laser scanning and exposure apparatus with polygon mirror system. The writing portion 3Y scans by laser light based on the image information signal to form electrostatic latent images on the photosensitive drum 1Y which rotates to the sub scanning direction D2 under a motor control. The developing portion 4Y develops the electrostatic latent images formed on the photosensitive drum 1Y using yellow toner. Thus, a toner image that is a visible image is formed on the photosensitive drum 1Y.

The intermediate transfer belt 8 is an endless belt. The intermediate transfer belt 8 runs on plural rollers with it being stretched and supported by them. When the intermediate transfer belt 8 runs under control of a motor, the yellow toner image formed on the photosensitive drum 1Y is transferred on a transferred position of the intermediate transfer belt 8 (Primary Transfer). When transferring the yellow toner image, the intermediate transfer belt 8 moves toward the next photosensitive drum 1M which is arranged at a downstream (lower) side of the photosensitive drum 1Y.

Similar to a case of the yellow, the magenta toner image is formed on the photosensitive drum 1M. The magenta toner image formed on the photosensitive drum 1M is transferred on the transferred position of the intermediate transfer belt 8 while the magenta toner image is overlaid on the yellow toner image. The intermediate transfer belt 8 then moves toward the photosensitive drums 1C, 1Y and the cyan toner image and the black toner image are transferred on the transferred position of the intermediate transfer belt 8 while the cyan toner image and the black toner image are overlaid in order to form a color image.

Figure 3:
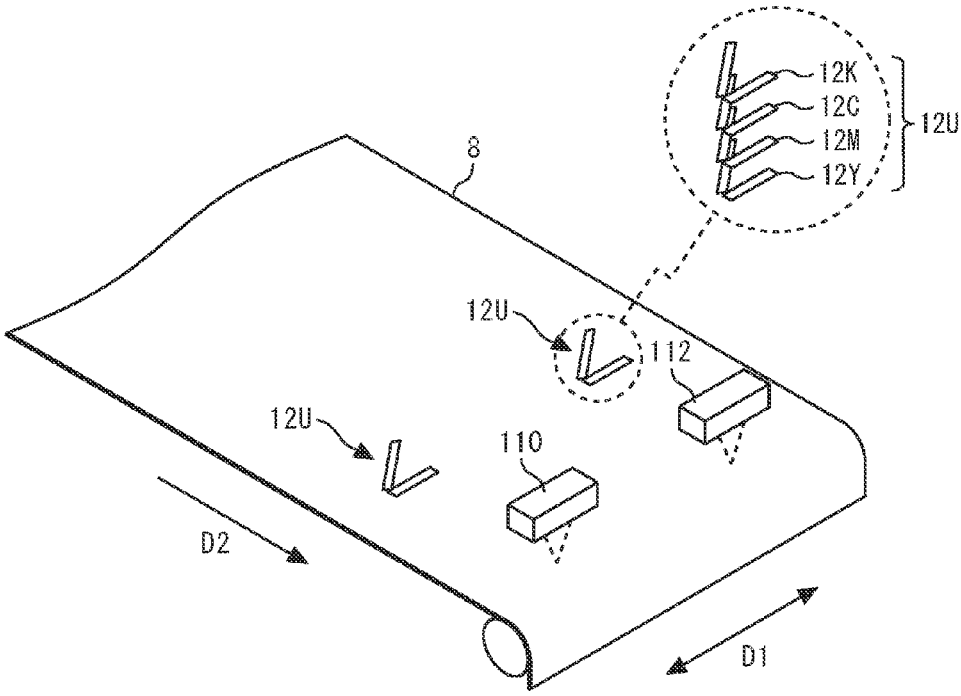
FIG. 3 is a perspective view of an intermediate transfer belt showing a configuration example of decision registration marks formed on the intermediate transfer belt.

Color registration sensors 110, 112 are examples of the detection portion and they are arranged at positions of the apparatus which respectively correspond to both ends of the intermediate transfer belt 8 along the main scanning direction D1 (see FIG. 3). In this embodiment, although the color registration sensors 110, 112 are arranged at lower positions of the photosensitive drum 1K, they are not limited thereto insofar as they are arranged at positions of the apparatus above the intermediate transfer belt 8. Respective color registration sensors 110, 112 are composed of, for example, reflection type sensors (photo sensors). The color registration sensors 110, 112 detect color registration marks 12Y, 12M, 12C and 12K formed on the intermediate transfer belt 8.

The feeder 20 has plural feeding trays 20*a*, 20B each containing sheets of paper with a size such as A3, A4 or the like. The feeder 20 feeds the sheets of paper P one by one from the selected feeding tray and conveys the fed sheet of paper P to the registration rollers 32 through conveying rollers 22, 24, 26 and 28 and loop-forming rollers 30. Numbers of the feeding trays are not limited to two. A single or plural large capacity sheet feeder(s), which can contain a large number of sheets of paper P, may connect the image forming apparatus depending on the situation.

The registration rollers 32 include a driving roller and a driven roller. The loop-forming rollers 30 hit a forward end of the sheet of paper P to the registration rollers 32 to form a loop so that a skew (inclination) of the sheet of paper P can be corrected. The registration rollers 32 conveys the sheet of paper P to a secondary transfer portion 34, which contains a transfer roller and a follower roller, at desired timing. The secondary transfer portion 34 transfers the color image formed by overlaying respective toner images on each other on the transferred position of the intermediate belt 8 to a surface of the sheet of paper P fed from the feeder 20 altogether (Secondary Transfer). The secondary transfer portion 34 then conveys to the fixing portion 44 the sheet of paper P on which the color image is formed.

The fixing portion 44 contains a pressure roller and a heating roller. The fixing portion 44 fixes the toner images transferred on a surface side of the sheet of paper P by applying pressure to the sheet of paper P to which the toner images are transferred in the secondary transfer portion 34 and/or heating the same.

A conveying path changeover portion 48 for changing over the conveying path of the sheet of paper P to a sheet discharging side or a side of ADU 60 is provided at a downstream side of the fixing portion 44 along a sheet-conveying direction. The conveying path changeover portion 48 is composed of, for example, a solenoid, a motor and the like. The conveying path changeover portion 48 performs changeover control of the conveying path based on a selected printing mode (single surface printing mode or duplex printing mode).

Ejection rollers 46, which is provided at downstream side of the fixing portion 44 along the sheet-conveying direction, eject onto an sheet-ejection tray, not shown, the sheet of paper P fixed by the fixing portion 44. At this time, a single surface of the sheet of paper P has been printed in the single surface printing mode or both surfaces of the sheet of paper P have been printed in the duplex printing mode.

When re-feeding the sheet of paper P to the secondary transfer portion 34 during the duplex printing mode, the sheet of paper P, on a surface side of which an image is formed, is conveyed to ADU 60 via the conveying path changeover portion 48. The conveying rollers 62 or the like convey the sheet of paper, which is conveyed to the ADU 60, to a switchback route. In the switchback route, ADU rollers 64 perform a reverse rotation control on the sheet of paper P to convey the sheet of paper P to a U-turn path with a rear end of the sheet of paper P being lead. The conveying rollers 66, 68 and the like provided in the U-turn path re-feed the sheet of paper P to the secondary transfer portion 34 while front and back of the sheet of paper P is reversed. The sheet of paper P re-fed to the secondary transfer portion 34 is subject to any image forming process which is similar to the image forming process that has been carried out in the front surface side of the sheet of paper P.

[Configuration Example of Decision Registration Mark]

Figure 4:
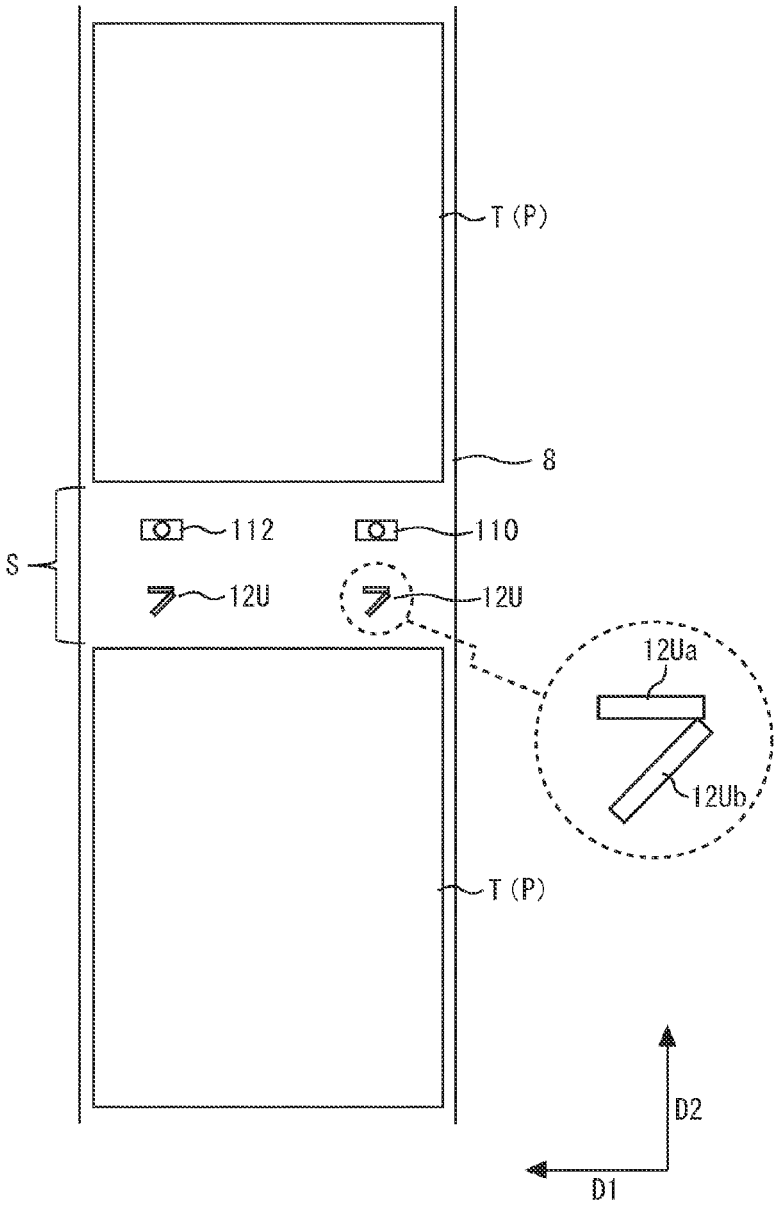
FIG. 4 is a top plan view of an intermediate transfer belt showing a configuration example of the decision registration marks formed on the intermediate transfer belt.

The following will describe a configuration example of the decision registration mark 12U. FIGS. 3 and 4 show a configuration example of the decision registration mark 12U. As shown in FIG. 4, the image forming portion 10 forms the decision registration marks 12U within a space S provided on the intermediate transfer belt 8 between the adjacent image forming regions T, T (the sheets of paper P, P) during consecutive printing operations. The image forming portion 10 forms the decision registration marks 12U at respective positions on both end sides of the intermediate transfer belt 8 along the main scanning direction D1. It is to be noted that in this embodiment, a size of the image forming region T is set to the size that is the same as the size of the sheet of paper P, for convenience's sake.

As shown in FIG. 3, the image forming portion 10 registers four different color registration marks 12Y, 12M, 12C and 12K to be used in the color registration correction to constitute the decision registration mark 12U. In other words, the color registration mark 12M registers the color registration mark 12Y; the color registration marks 12C registers the color registration mark 12M; and the color registration marks 12K registers the color registration mark 12C. Accordingly, when any positional shifts do not occur in the respective color registration marks 12Y, 12M, 12C and 12K, they appear to be one color registration mark.

The decision registration mark 12U contains a pattern 12Ua extending to the main scanning direction D1 and a pattern 12Ub extending diagonally with respect to the pattern 12Ua. The decision registration mark 12U is configured so that it is seen as roughly "V" shaped, as seen in a plane. It is to be noted that a shape of each of the color registration marks 12Y, 12M, 12C and 12K constituting the decision registration mark 12U is not limited to the rough shape of "V" and another shape may be adapted.

[Configuration Example of Image Forming Apparatus]

Figure 5:
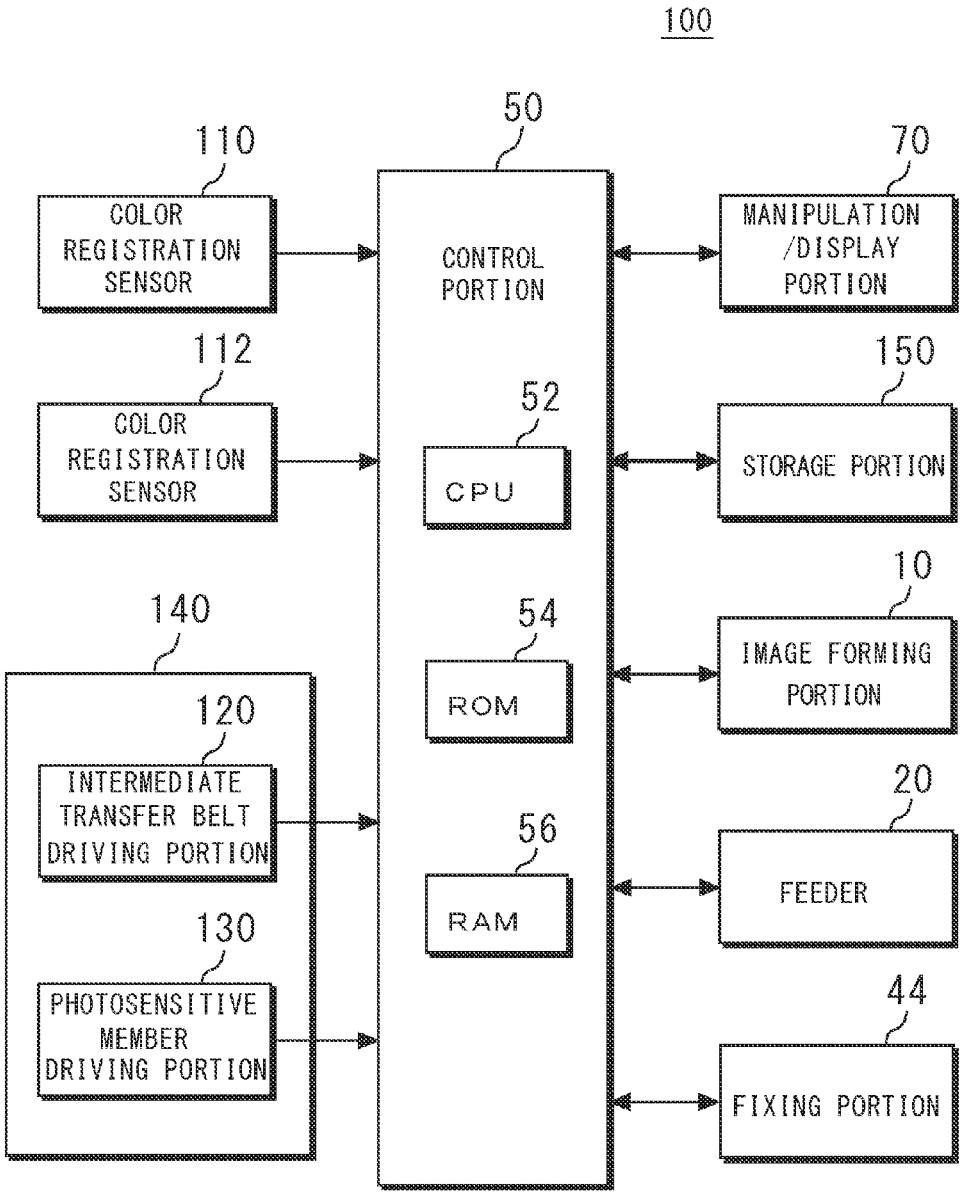
FIG. 5 is a block diagram showing a configuration example of the image forming apparatus.

The following will describe a configuration example of the image forming apparatus 100 according to the first embodiment of the invention. FIG. 5 shows the configuration example of the image forming apparatus 100. As shown in FIG. 5, the image forming apparatus 100 contains a control portion 50 for controlling operations of the whole apparatus. The control portion 50 includes a central processing unit (CPU) 52, a read only memory (ROM) 54 that stores control software and data and a random access memory (RAM) 56 that configures a work area for CPU 52. CPU 52 reads the control software and/or data out of the ROM 54 and extracts them on the RAM 56 to start the control software. CPU 52 then controls respective parts of the image forming apparatus 100 to perform the image forming operation, the color registration correction, the decision operation on whether or not the color registration correction carries out.

The control portion 50 connects the color registration sensors 110, 112, the manipulation/display portion 70, a storage portion 150, the image forming portion 10, a conveying portion 140, the feeder 20 and the fixing portion 44, respectively. The color registration sensors 110, 112 respectively detect the decision registration mark 12U and the color registration marks 12Y, 12M, 12C and 12K formed on the intermediate transfer belt 12U during the color registration correction and the decision operation on whether or not the color registration correction carries out. The color registration sensors 110, 112 supply an analog detection signal (voltage value) thus obtained by this detection to the control portion 50.

The storage portion 150 contains nonvolatile semiconductor element, hard disk drive and the like. The storage portion 150 stores image data read by the image reading portion 90. The storage portion 150 also stores data on the respective color registration marks, threshold values Th, periods of detection time T1, T2 and the like.

The manipulation/display portion 70 displays a predetermined manipulation screen based on any display control by the control portion 50 and receives an input of frequency of forming the decision registration mark 12U on the manipulation screen to supply the manipulation signal to the control portion 50. This allows a user to change the frequency of forming the decision registration mark 12U optionally. This also allows the periods of detection time T1, T2 to change optionally based on their required accuracies.

The conveying portion 140 contains an intermediate transfer belt driving portion 120 and a photosensitive member driving portion 130. The intermediate transfer belt driving portion 120 is composed of, for example, a stepping motor. The intermediate transfer belt driving portion 120 rotates based on a driving signal received from the control portion 50 to move the intermediate transfer belt 8 to the sub scanning direction D2. The photosensitive member driving portion 130 is composed of, for example, a stepping motor. The photosensitive member driving portion 130 rotates based on a driving signal received from the control portion 50 to rotate the respective photosensitive drums 1Y, 1M, 1C and 1K to the sub scanning direction D2.

The image forming portion 10 performs writing on the respective photosensitive drums 1Y, 1M, 1C and 1K using laser light based on the image data read out of the storage portion 150 under the control of the control portion 50. The image forming portion 10 also performs writing on the respective photosensitive drums 1Y, 1M, 1C and 1K using laser light by controlling writing timing based on the registration mark data read out of the storage portion 150 under the control of the control portion 50 so that respective color registration marks 12Y, 12M, 12C and 12K can be transferred on the intermediate transfer belt 8.

The feeder 20 takes the sheet of paper P, which corresponds to image forming condition such as a size of the sheet of paper input on the manipulation screen of the manipulation/display portion 70, out of the feeding tray 20*a* or 20B to feed it to the secondary transfer portion 34 based on an instruction from the control portion 50.

The fixing portion 44 adjusts temperature or the like based on the control of the temperature, pressure and the like by the control portion 50 to fix the toner images on the sheet of paper P.

[Forming Example and Detection Example of Registration Mark when Color Shifts do not Occur]

Figure 6A:
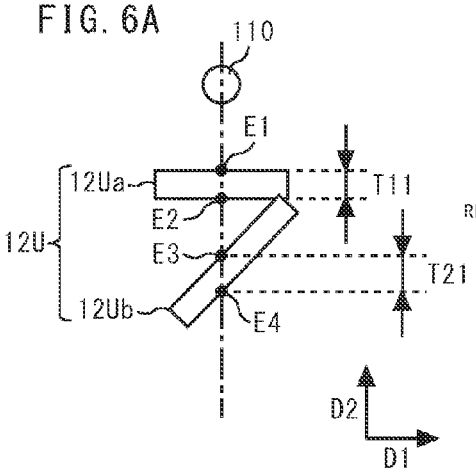
FIG. 6A is a diagram showing a formation example of a decision registration mark when color shifts do not occur and FIG. 6B is a graph showing a detection example of the decision registration mark when color shifts do not occur.
Figure 6B:
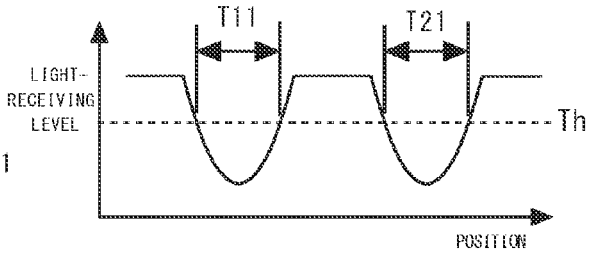

The following will describe forming example and detection example of the decision registration mark 12U during the decision operation on whether or not the color registration correction carries out if color shifts do not occur. FIG. 6A shows a formation example of the decision registration mark 12U when color shifts do not occur and FIG. 6B shows a detection example of the decision registration mark 12U when color shifts do not occur. It is to be noted that in this embodiment, two color registration sensors 110, 112 respectively detect the decision registration marks 12U, 12U. Since the detection operation and the like of the color registration sensors 110, 112 are common to each other, the following will describe only the color registration sensor 110.

In a normal case where color shifts do not occur, as shown in FIG. 6A, the respective color registration marks 12Y, 12M, 12C and 12K are formed at the same position with them being registered so that one decision registration mark 12U is apparently formed on the intermediate transfer belt 8.

During the decision operation on whether or not the color registration correction carries out, the color registration sensor 110 detects edges E1, E2, respectively, of the pattern 12Ua in the decision registration mark 12U, in order to decide whether or not the color shifts occur along the sub scanning direction D2. The edges E1, E2 are edges of the pattern 12Ua along the sub scanning direction D2. The control portion 50 calculates a period of detection time (width) T11 between the edges E1 and E2 based on the positions of the edges E1, E2 detected by the color registration sensor 110 and a previously set threshold value Th. When color shifts do not occur, the period of detection time along the sub scanning direction D2 is T11.

Similarly, the color registration sensor 110 detects edges E3, E4, respectively, of the pattern 12Ub extending diagonally with respect to the sub scanning direction D2 in the decision registration mark 12U in order to decide whether or not the color shifts occur along the main scanning direction D1. The edges E3, E4 diagonally intersect the sub scanning direction D2. The control portion 50 calculates a period of detection time T21 between the edges E3 and E4 based on the positions of the edges E3, E4 detected by the color registration sensor 110 and the previously set threshold value Th. When color shifts do not occur, the period of detection time along the main scanning direction D1 is T21.

[Forming Example and Detection Example of Registration Mark when Color Shifts Occur Along Sub Scanning Direction]

Figure 7A:
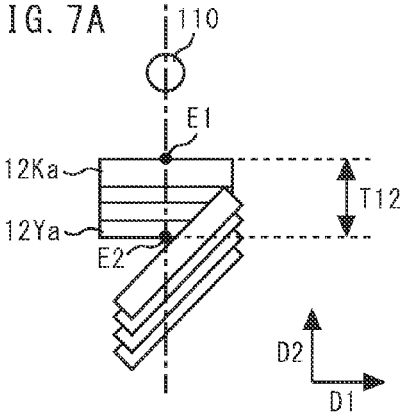
FIG. 7A is a diagram showing a formation example of a decision registration mark when color shifts occur along a sub scanning direction and FIG. 7B is a graph showing a detection example of the decision registration mark when color shifts occur along the sub scanning direction.

The following will describe forming example and detection example of the registration mark 12U during the decision operation on whether or not the color registration correction carries out if color shifts occur along the sub scanning direction D2. FIG. 7A shows a formation example of the decision registration mark 12U when color shifts occur along the sub scanning direction D2 and FIG. 7B shows a detection example of this decision registration mark 12U.

In a case where color shifts occur along the sub scanning direction D2, as shown in FIG. 7A, the respective color registration marks 12Y, 12M, 12C and 12K constituting the decision registration mark 12U are formed on the intermediate transfer belt 8 with them being shifted and overlapped by a designated distance to the sub scanning direction D2. Although it is shown in FIG. 7A that the respective color registration marks 12Y, 12M, 12C and 12K are shifted by the same distance to the sub scanning direction D2, a shift amount of each color registration mark may be different from each other based on a transfer condition.

During the decision operation on whether or not the color registration correction carries out, the color registration sensor 110 detects an edge E1 of the pattern 12Ka in a black registration mark 12K along the sub scanning direction D2. The color registration sensor 110 then detects an edge E2 of the pattern 12Ya in a yellow registration mark 12Y along the sub scanning direction D2. In this case, a period of detection time when detecting the edge E2 becomes later than the normal time when the color shifts do not occur by the shift amount of the respective color registration marks 12Y, 12M and 12C along the sub scanning direction D2. The control portion 50 calculates a period of detection time T12 between the edges E1 and E2 based on the positions of the edges E1, E2 detected by the color registration sensor 110 and a previously set threshold value Th, as shown in FIG. 7B.

Figure 7B:
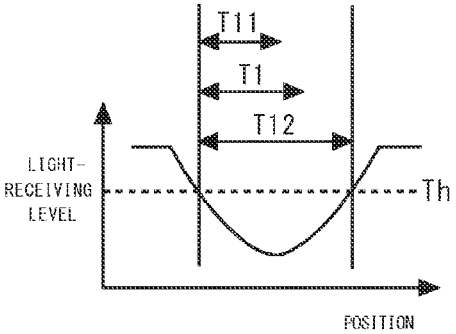

In this embodiment, it is decided whether or not the color shifts occur along the sub scanning direction D2, as shown in FIG. 7B, using a period of the reference time T1. The period of the reference time T1 is set to be some longer than the period of time T11 when the color shifts do not occur. In the other words, the period of the reference time T1 is set to have a predetermined tolerance and it is decided that the color shifts occur along the sub scanning direction D2 when the period of detection time T12 exceeds the period of the reference time T1.

[Forming Example and Detection Example of Registration Mark when Color Shifts Occur Along Main Scanning Direction]

Figure 8A:
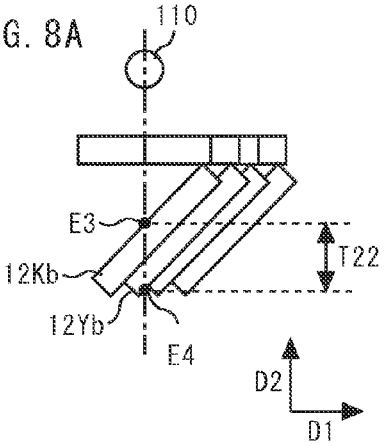
FIG. 8A is a diagram showing a formation example of a decision registration mark when color shifts occur along a main scanning direction and FIG. 8B is a graph showing a detection example of the decision registration mark when color shifts occur along the main scanning direction.

The following will describe forming example and detection example of the registration mark 12U during the decision operation on whether or not the color registration correction carries out if color shifts occur along the main scanning direction D1. FIG. 8A shows a formation example of the decision registration mark 12U when color shifts occur along the main scanning direction D1 and FIG. 8B shows a detection example of this decision registration mark 12U.

In a case where color shifts occur along the main scanning direction D1, as shown in FIG. 8A, the respective color registration marks 12Y, 12M, 12C and 12K constituting the decision registration mark 12U are formed on the intermediate transfer belt 8 with them being shifted and overlapped by a designated distance to the main scanning direction D1. Although it is shown in FIG. 8A that the respective color registration marks 12Y, 12M, 12C and 12K are shifted by the same distance to the main scanning direction D1, a shift amount of each color registration mark may be different from each other based on a transfer condition.

During the decision operation on whether or not the color registration correction carries out, the color registration sensor 110 detects an edge E3 of the pattern 12Kb, which diagonally intersects the sub scanning direction D2, in a black registration mark 12K. The color registration sensor 110 then detects an edge E4 of the pattern 12Yb, which diagonally intersects the sub scanning direction D2, in a yellow registration mark 12Y. In this case, a period of detection time when detecting the edge E4 becomes later than the normal time when the color shifts do not occur by a shift amount of the respective color registration marks 12Y, 12M and 12C along the main scanning direction D1. The control portion 50 calculates a period of detection time T22 between the edges E3 and E4 based on the positions of the edges E3, E4 detected by the color registration sensor 110 and the previously set threshold value Th.

Figure 8B:
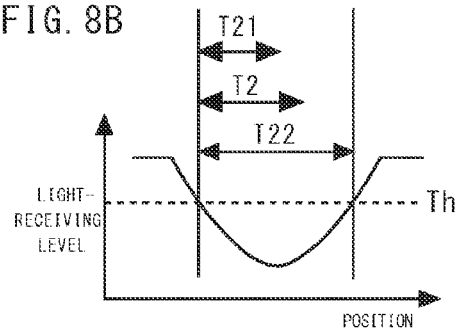

In this embodiment, as shown in FIG. 8B, it is decided whether or not the color shifts occur along the main scanning direction D1 using a period of the reference time T2. The period of the reference time T2 is set to be some longer than the period of time T21 when the color shifts do not occur. In the other words, the period of the reference time T2 is set to have a predetermined tolerance and it is decided that the color shifts occur along the main scanning direction D1 when the period of detection time T22 exceeds the period of the reference time T2.

[Operation Example of Image Forming Apparatus]

Figure 9:
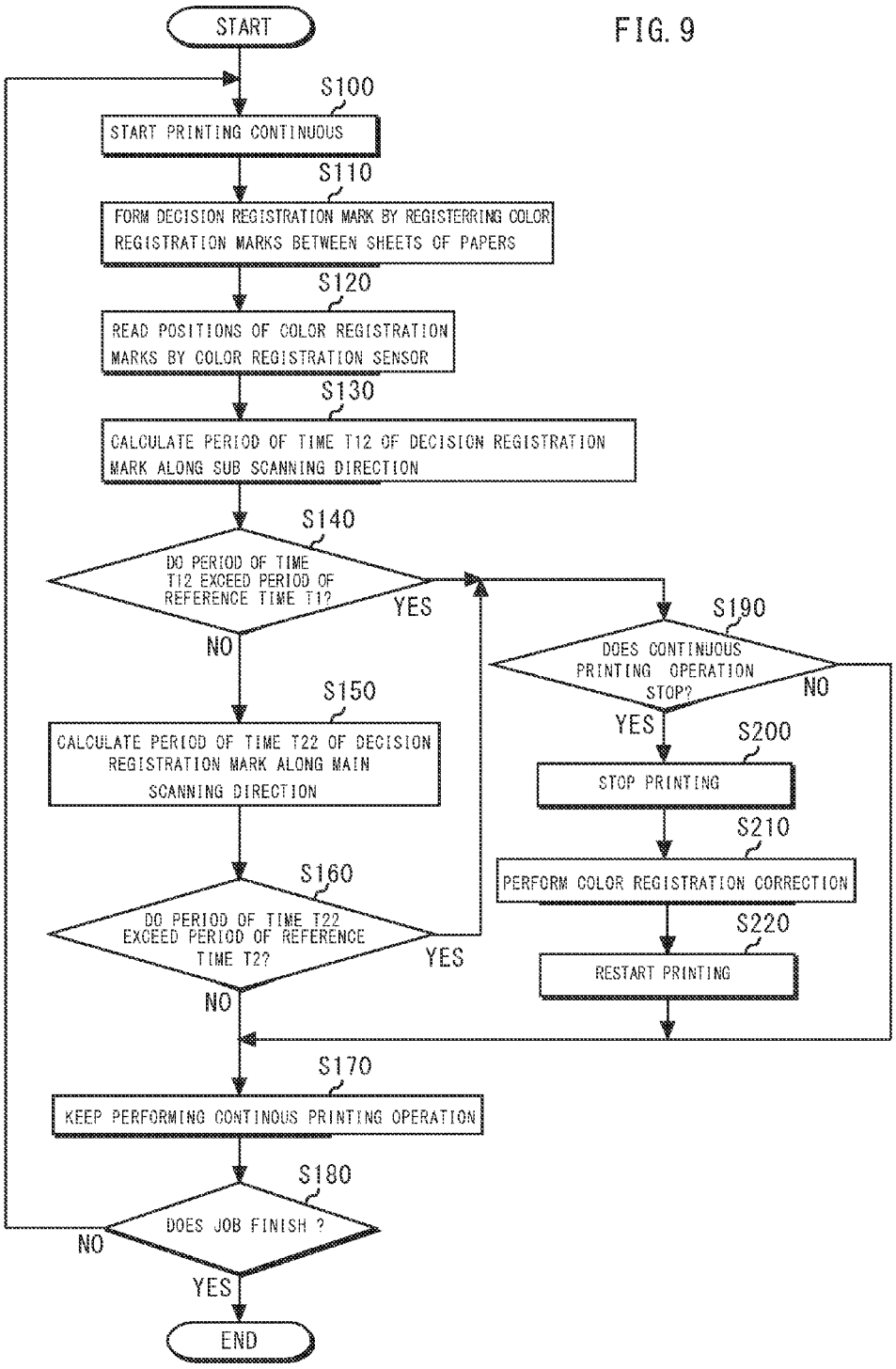
FIG. 9 is a flowchart showing the decision operation example of the image forming apparatus on whether or not the color registration correction carries out.

The following will describe an operation example of the image forming apparatus 100 when performing the decision operation on whether or not the color registration correction carries out with reference to FIG. 9. FIG. 9 shows the decision operation of the image forming apparatus 100 on whether or not the color registration correction carries out.

As shown in FIG. 9, at a step S100, when the user selects a start of a job on the manipulation/display portion 70 or the like, the control portion 50 controls operations of the image forming portion 10, the conveying portion 140 and the like to start continuous printing based on the input job. In this moment, by the conveying portion 140, the feeder 20 feeds sheets of paper P to the secondary transfer portion 34 continuously with them having a predetermined space S. The control portion 50 goes to a step S110 after the printing starts.

At the step S110, the control portion 50 forms the respective color registration marks 12Y, 12M, 12C and 12K constituting the decision registration mark 12U within a space S, which is provided between the sheets of paper P, P, on a surface of the intermediate transfer belt 8 with them being registered in order. The control portion 50 may form the decision registration marl 12U for each sheet of paper or for every predetermined sheets of paper. The user may manipulate the manipulation/display portion 70 to set the timing (frequency) of forming the decision registration mark 12U optionally. The control portion 50 goes to a step S120 after it forms the decision registration mark 12U.

At the step S120, the color registration sensor 110 detects (reads) the decision registration mark 12U formed on the surface of the intermediate transfer belt 8. The color registration sensor 110 detects the positions of the edges E1, E2 of the decision registration mark 12U to decide whether or not the color shifts occur along the sub scanning direction D2 and outputs the detection results to the control portion 50. The control portion 50 goes to a step S130 when detecting the decision registration mark 12U.

At the step S130, the control portion 50 calculates the period of detection time (detection width) T12 of the decision registration mark 12U along the sub scanning direction D2 from the positions of the edges E1, E2 of the decision registration mark 12U received from the color registration sensor 110 as the detection results (see FIGS. 6 and 7). The control portion 50 goes to a step S140 when obtaining the period of detection time (detection width) T12 of the decision registration mark 12U along the sub scanning direction D2.

At the step S140, the control portion 50 determines whether or not the period of detection time T12 of the decision registration mark 12U along the sub scanning direction D2 exceeds the previously set period of reference time T1. The control portion 50 reads the period of reference time T1 out of the storage portion 150 and compares the period of detection time T12 detected by the color registration sensor 110 with the read period of reference time T1. The control portion 50 determines that color shifts occur along the sub scanning direction D2 when the period of detection time T12 of the decision registration mark 12U along the sub scanning direction D2 exceeds the period of reference time T1 and goes to a step S190. On the other hand, the control portion 50 determines that color shifts do not occur along the sub scanning direction D2 when the period of detection time T12 of the decision registration mark 12U along the sub scanning direction D2 does not exceed the period of reference time T1 and goes to a step S150.

At the step S150, the control portion 50 calculates the period of detection time (detection width) T22 of the decision registration mark 12U along the main scanning direction D1 from the positions of the edges E3, E4 of the decision registration mark 12U received from the color registration sensor 110 as the detection results (see FIGS. 6 and 8). The control portion 50 goes to a step S160 when obtaining the period of detection time T22 of the decision registration mark 12U along the main scanning direction D1.

When determining that the color shifts do not occur along the sub scanning direction D2, the control portion 50 determines whether or not the color shifts occur along the main scanning direction D1, at the step S160. The control portion 50 determines whether or not the period of detection time T22 of the decision registration mark 12U along the main scanning direction D1 exceeds the previously set period of reference time T2. The control portion 50 reads the period of reference time T2 out of the storage portion 150 and compares the period of detection time T22 detected by the color registration sensor 110 with the read period of reference time T2. The control portion 50 determines that color shifts occur along the main scanning direction D1 when the period of detection time T22 of the decision registration mark 12U along the main scanning direction D1 exceeds the period of reference time T2 and goes to the step S190. On the other hand, the control portion 50 determines that the color shifts do not occur along the main scanning direction D1 when the period of detection time T22 of the decision registration mark 12U along the main scanning direction D1 does not exceed the period of reference time T2 and goes to a step S170.

When determining that the color shifts occur along the sub scanning direction D2 or the main scanning direction D1, the control portion 50 determines whether or not the printing operation stops at the step S190. For example, it is determined on whether or not the user selects to stop the printing operation on the manipulation screen of the manipulation/display portion 70. The control portion 50 goes to a step S200 when it determines that the printing operation stops or goes to the step S170 when it does not determine that the printing operation stops.

At the step S200, the control portion 50 stops feeding the sheets of paper P when selecting the stop of the printing operation and stops the continuous printing operation. The control portion 50 goes to a step S210 when stopping the continuous printing operation.

At the step S210, the control portion 50 carries out the color registration correction. In the color registration correction, when forming the decision registration mark 12U on the intermediate transfer belt 8 by registering the respective color registration marks 12Y, 12M, 12C and 12K in order, the color registration sensor 110 detects shift amount thereof along the main scanning direction and/or the sub scanning direction and the control portion 50 calculates a color shift amount in each color. The control portion 50 goes to a step S220 when calculating the color shift amount in each color.

At the step S220, the control portion 50 restarts the printing operation. In the restarted printing operation, by feeding back the correction values based on the color shift amount in each color calculated at the step S210 to the image forming portion 10 and the like, the control portion 50 corrects and controls any writing timing or the like to form a desired image on the sheets of paper P. The control portion 50 goes to the step S170 when restarting the printing operation.

At the step S170, the control portion 50 keeps performing the continuous printing operation based on the contents of job. At a step S180, the control portion 50 determines whether or not the job in the continuous printing operation finishes. The control portion 50 finishes a series of the continuous printing operation when determining that the job in the continuous printing operation finishes. On the other hand, the control portion 50 returns to the step S100 where the control portion 50 performs the above-mentioned decision operation on whether or not the color registration correction carries out in the continuous printing operation when determining that the job in the continuous printing operation does not finish.

Additionally, although, in the above-mentioned embodiment, in the four color registration marks 12Y, 12M, 12C and 12K registered on the same position on the intermediate transfer belt 8, it has been previously determined whether or not the color shifts occur along the sub scanning direction D2, this invention is not limited thereto. It may be previously determined whether or not the color shifts occur along the main scanning direction D1.

As described above, according to the first embodiment, before the color registration correction, the decision registration mark 12U is formed within the space S on the intermediate transfer belt 8 between the sheets of paper P, P while the respective color registration marks 12Y, 12M, 12C and 12K constituting the decision registration mark 12U are registered on the same position. The control portion 50 calculates the color shift amount (periods of detection time) in the decision registration mark 12U. The control portion 50 determines whether or not the color registration correction carries out based on each of the periods of detection time exceeds the set period of reference time T1 or T2. This enables numbers of the carried-out color registration marks to decrease so that the color registration corrections can be efficiently carried out. It is thus possible to realize any improvement in the efficiency of printing. Many color registration marks are not used and each one color registration mark constitutes the decision registration mark 12U so that it is possible to realize a reduction of the amount of consumption of the toner.

Further, by forming the decision registration mark 12U for every predetermined time, it is possible to detect color shifts steady when the color shifts suddenly occur by attaching any scratch and dusty to the intermediate transfer belt 8 or when the temperature rise in the image forming apparatus is in saturation and the temperature in the image forming apparatus does not exceed the threshold temperature. This enables the color registration correction to carry out even in these conditions.

Since the decision registration mark 12U is formed on the intermediate transfer belt 8 within the space S between the sheets of paper P, P, (or between the image forming regions T, T), the image forming apparatus 100 according to this embodiment can deal with even if the space between the sheets of paper P, P is narrow-pitched. Since the decision registration mark 12U is formed by registering the four color registration marks 12Y, 12M, 12C and 12K, it is possible to determine whether or not the color shifts occur under the same conditions as those in the case of actually forming the color image. This enables the decision on whether or not the color registration correction carries out to be more accurately performed.

Second Embodiment

The second embodiment is different from the first embodiment in that a frequency (timing) of forming the decision registration marks 12U is determined on the basis of variation amounts of widths of the decision registration marks 12U. It is to be noted that since other configurations and functions of the image forming apparatus of the second embodiment is similar to those of the image forming apparatus of the first embodiment, the same symbols are attached to common components and their detailed description will be omitted.

[Reference Variation Amounts]

In the second embodiment, the decision registration marks 12U are formed plural times on a surface of the intermediate transfer belt 8. The control portion 50 calculates the variation amounts in plural detection widths of the respective decision registration marks 12U formed plural times. The control portion 50 determines (or changes) the frequency of forming the decision registration marks 12U based on the calculated variation amounts by referring to a Table TB1.

Figures 10, 11:
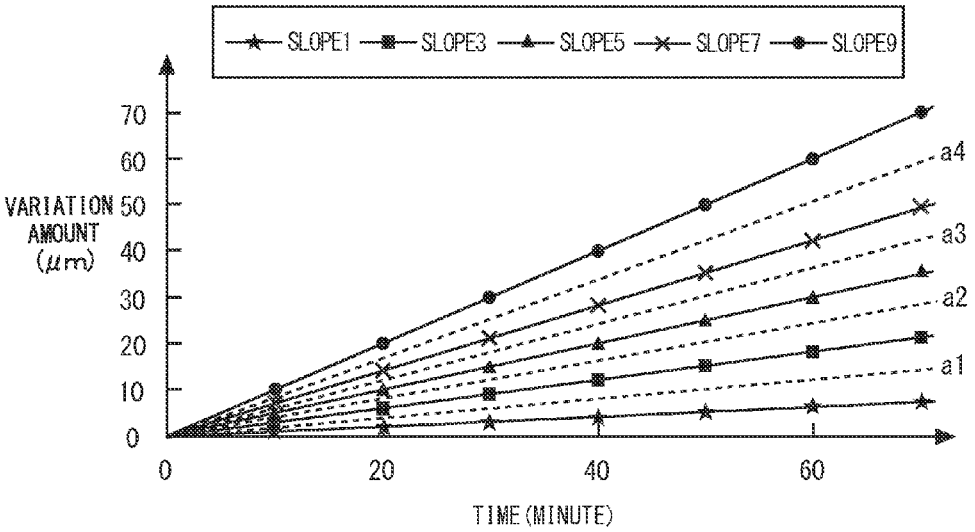
FIG. 10 is a graph showing reference variation amounts as threshold values used in a case of deciding a frequency of forming decision registration marks in an image forming apparatus according to a second embodiment of the invention.
FIG. 11 is a diagram showing a configuration example of a table in which the frequencies of forming decision registration marks corresponding to ranges of reference variation amounts of the detection widths are stored.

FIG. 10 shows reference variation amounts as threshold values used in a case of deciding a frequency of forming the decision registration marks 12U. A vertical axis thereof indicates a variation amount of the detection width (detection time) and a horizontal axis thereof indicates time. In this embodiment, four reference variation amounts a1, a2, a3 and a4 are set. Each of the reference variation amounts a1, a2, a3 and a4 is a slope showing a variation amount (the rate of variation) in the detection widths of the decision registration marks 12U for a predetermined period of time. The slopes of the respective reference variation amounts a1, a2, a3 and a4 are so set as to have a relationship of $a1<a2<a3<a4$. The relationship indicates that the reference variation amount becomes larger as the reference variation amount goes to a4. It is possible to set the respective reference variation amounts a1, a2, a3 and a4 based on, for example, the data obtained by an actual measurement and the like at a shipping time of an image forming apparatus.

[Configuration Example of Table]

FIG. 11 shows a configuration example of the table TB1 used when obtaining frequencies of forming the decision registration marks 12U. The storage portion 150 shown in FIG. 5 stores the table TB1. The table TB1 includes a range of reference variation amount and a frequency of forming the decision registration marks with them corresponding to each other.

For example, as shown in FIG. 11, when a slope of the detected reference variation amount is $0 \leq a < a1$, a variation amount in the color shift amount is small so that as the frequency of forming the decision registration marks 12U, the storage portion 150 stores "one time per 100 sheets of normal paper" corresponding thereto. Further, when a slope of the detected reference variation amount is $a \leq a4$, a variation amount in the color shift amount is large so that as the frequency of forming the decision registration marks 12U, the storage portion 150 stores "one time per each sheet" corresponding thereto.

[Operation Example of Image Forming Apparatus]

The following will describe an operation example of the image forming apparatus 100 according to the second embodiment. In the following description, a case where the color registration sensor 110 detects a decision registration mark 12U of the two decision registration marks 12U, 12U formed on the intermediate transfer belt 8 will be described.

The control portion 50 controls the image forming portion 10 or the like to form the decision registration marks 12U on the space S in the intermediate transfer belt 8 between the sheets of paper P, P. In this embodiment, as shown in FIG. 10, the image forming portion 10 or the like forms the decision registration marks 12U seven times for every 10 minutes. The color registration sensor 110 detects each decision registration mark 12U for each time formed on the surface of the intermediate transfer belt 8 and outputs to the control portion 50 the detection width of each decision registration mark 12U along the sub scanning direction D2.

The control portion 50 receives the detection width of each decision registration mark 12U along the sub scanning direction D2 for each time from the color registration sensor 110 to calculate a slope showing variation amount in the color shift amount based on the received detection width of each decision registration mark 12U for each time. In this embodiment, as the calculated slope showing the variation amount in the color shift amount, FIG. 10 illustrates slopes 1, 3, 5, 7 and 9. The control portion 50 refers to the table TB1 shown in FIG. 11 after the slope showing the variation amount in the color shift amount is calculated. The control portion 50 reads out of the storage portion 150 "the frequency of forming the decision registration marks" corresponding to the range of reference variation amount in which the calculated slope is included and sets it.

For example, when the slope of the calculated variation amount is the slope 1, as shown in FIG. 11, the range of reference variation amount is $0 \leq a < a1$. The control portion 50 refers to the table TB1 and reads out of the storage portion 150 "one time per 100 sheets" as "the frequency of forming the decision registration marks" to set it. Moreover, when the slope of the calculated variation amount is the slope 3, the range of reference variation amount is $a1 \leq a < a2$. The control portion 50 refers to the table TB1 and reads out of the storage portion 150 "one time per 50 sheets" as "the frequency of forming the decision registration marks" to set it. When the slope of the calculated variation amount is the slope 5, 7 or 9, it is possible to calculate the frequency of forming the decision registration marks similarly.

The control portion 50 controls the image forming portion 10 or the like to form the decision registration marks 12U on the intermediate transfer belt 8 based on the set frequency of forming the decision registration marks 12U. The control portion 50 decides whether or not the color registration correction carries out based on the detection widths of the decision registration marks 12U detected by the color registration sensor 110 or the like. The control portion 50 then carries out the color registration correction based on the determination results.

As described above, according to the second embodiment, the control portion 50 determines the frequency of forming the decision registration marks 12U based on the slope showing the variation amount in the detection widths of the decision registration marks 12U so that it is possible to determine that a possibility such that color shift amount exceeds the reference period of detection time T1 is low when the variation amount in the color shift amount is small. In this case, since the frequency of forming the decision registration marks 12U can be decreased, the amount of toner consumption may be also decreased.

It is to be noted that although, in the above-mentioned embodiment, the frequency of forming the decision registration marks 12U has been determined on the basis of the detection widths of each of the decision registration marks 12U along the sub scanning direction D2, this invention is not limited thereto. The frequency of forming the decision registration marks 12U may be determined on the basis of the detection widths of each of the decision registration marks 12U along the main scanning direction D1. Further, the frequency of forming the decision registration marks 12U may be determined by taking them into consideration.

Third Embodiment

The third embodiment is different from the first embodiment in that the frequency of forming the decision registration marks 12U is determined on the basis of lengths of the detection widths of the decision registration marks 12U. It is to be noted that since other configurations and functions of the image forming apparatus of the second embodiment is similar to those of the image forming apparatus of the first embodiment, the same symbols are attached to common components and their detailed description will be omitted.

[Sub Reference Variation Amounts]

In the third embodiment, the color registration sensor 110 detects the detection widths of the decision registration marks formed on the surface of the intermediate transfer belt 8 along the sub scanning direction. The control portion 50 determines (or changes) the frequency of forming the decision registration marks 12U based on the lengths of the detection widths of the decision registration marks 12U obtained by this detection by referring to a Table TB2.

Figures 12, 13:
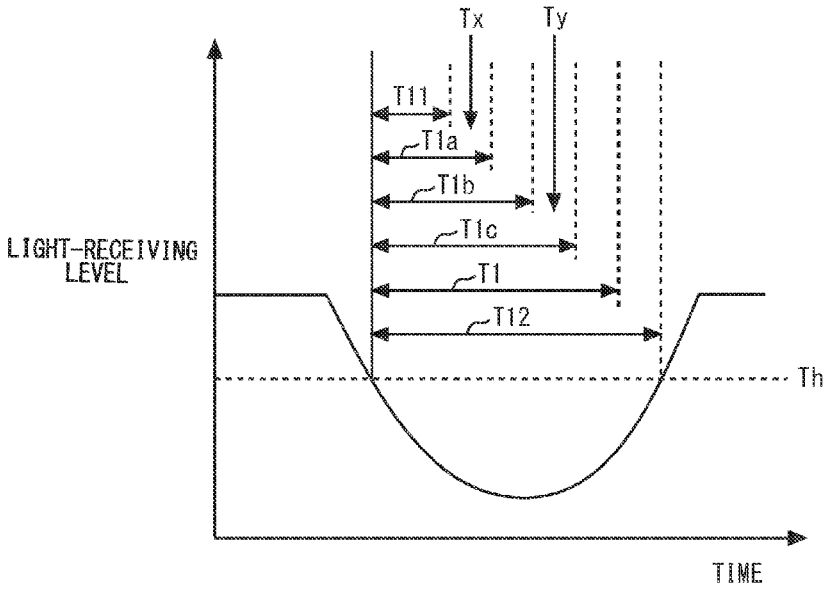
FIG. 12 is a graph showing reference periods of detection time as threshold values used in a case of deciding a frequency of forming decision registration marks in an image forming apparatus according to a third embodiment of the invention.
FIG. 13 is a diagram showing a configuration example of a table in which frequencies of a formation of decision registration marks corresponding to periods of time for detecting the registration marks.

FIG. 12 shows sub reference periods of detection time T1a, T1b, T1c as the threshold values used in a case of deciding a frequency of forming decision registration marks 12U. In the third embodiment, three sub reference periods of detection time T1a, T1b, T1c are set. These sub reference periods of detection time T1a, T1b, T1c are set in three steps between the period of detection time T11 of the decision registration mark 12U when color shifts do not occur and the period of reference detection time T1 thereof when determining that color shifts occur so that they have a relationship of $T1a < T1b < T1c$.

[Configuration Example of Table]

FIG. 13 shows a configuration example of the table TB2. The storage portion 150 shown in FIG. 5 stores the table TB2. The table TB2 includes a range of sub reference detection width and a frequency of forming the decision registration marks with them corresponding to each other.

For example, as shown in FIG. 13, when the detection width Tx is T11≤Tx<T1a, the detection width Tx is close to the normal value (T11) in which the color shifts do not occur so that as the frequency of forming the decision registration marks 12U, the storage portion 150 stores "one time per 100 sheets of normal paper" corresponding thereto. Further, when the detection width Ty is T1b≤Ty<T1c, the detection width Ty is close to the reference period of detection time T1 when the color shifts occur so that as the frequency of forming the decision registration marks 12U, the storage portion 150 stores "one time per each sheet" corresponding thereto.

[Operation Example of Image Forming Apparatus]

The following will describe an operation example of the image forming apparatus 100 according to the third embodiment. In the following description, a case where the color registration sensor 110 detects a decision registration mark 12U of the two decision registration marks 12U, 12U formed on the intermediate transfer belt 8 will be described.

The control portion 50 controls the image forming portion 10 or the like to form the decision registration marks 12U on the space S on the intermediate transfer belt 8 between the sheets of paper P, P. The color registration sensor 110 detects a detection width of the pattern 12Ua of each of the decision registration marks 12U, which are formed on the surface of the intermediate transfer belt 8, along the sub scanning direction D2 and outputs it to the control portion 50.

The control portion 50 receives the detection width of each decision registration mark 12U along the sub scanning direction D2 for each time from the color registration sensor 110. The control portion 50 then refers to the table TB2 shown in FIG. 13 and stored in the storage portion 150 to determine which region of periods of sub reference time includes the length of the obtained detection width in the Table 2. After the region of periods of sub reference time including the length of the obtained detection width is determined, the control portion 50 reads out of the storage portion 150 "the frequency of forming the decision registration marks" corresponding to this range and sets it.

For example, when the detection width received from the color registration sensor 110 is Tx, as shown in FIG. 12, the range of sub reference detection width is T11≤Tx<T1a. The control portion 50 refers to the table TB2 and reads out of the storage portion 150 "one time per 100 sheets" as "the frequency of forming the decision registration marks" to set it. Moreover, when the detection width received from the color registration sensor 110 is Ty, the range of sub reference detection width is T1b≤Ty<T1c. The control portion 50 refers to the table TB2 and reads out of the storage portion 150 "one time per each sheet" as "the frequency of forming the decision registration marks" to set it.

The control portion 50 controls the image forming portion 10 or the like to form the decision registration marks 12U on the intermediate transfer belt 8 based on the set frequency of forming the decision registration marks 12U. The control portion 50 decides whether or not the color registration correction carries out based on the detection width of each of the decision registration marks 12U detected by the color registration sensor 110 or the like. The control portion 50 then carries out the color registration correction based on the determination results.

In contrast, as shown in FIG. 12, when the detection width of the decision registration marks 12U detected by the color registration sensor 110 is T12, the control portion 50 determines that the color shifts exceed the maximum permission limit thereof because the detection width T12 received from the color registration sensor 110 exceeds the period of reference detection time T1 and carries out the color registration correction.

As described above, according to the third embodiment, the control portion 50 determines the frequency of forming the decision registration marks 12U based on the lengths of the detection widths of the decision registration marks 12U so that it is possible to determine that a possibility such that the detection width rapidly exceeds the reference period of detection time T1 is low when the detection width is close to the normal value. In this case, since the frequency of forming the decision registration marks 12U can be decreased, the amount of toner consumption may be also decreased.

It should be understood by those skilled in the art that various modifications, combinations, sub-combinations and alterations may occur depending on design requirements and other factors insofar as they are within the scope of the appended claims or the equivalents thereof.

Although it has described in the above-mentioned embodiments that the control portion 50 controls the image forming portion 10 to form the decision registration mark 12U by registering the four color registration marks 12Y, 12M, 12C and 12K using four photosensitive drums 1Y, 1M, 1C and 1K, this invention is not limited thereto. For example, the control portion 50 may control the image forming portion 10 to form the decision registration mark 12U by registering two color registration marks using two photosensitive drums which are set on positions that are farthest from each other among the four photosensitive members. In this embodiment, the control portion 50 controls the image forming portion 10 to form the decision registration mark 12U by registering yellow and black color registration marks 12Y, 12K using two photosensitive drums 1Y and 1K. The two photosensitive drums 1Y and 1K which are set on positions that are farthest from each other are used because they are most subject to any influence when thermal extension occurs. This avoids the photosensitive drums 1M and 1C so that the amount of toner consumption may be further decreased.

Although it has described in the above-mentioned embodiments that the decision registration marks 12U are formed between the sheets of paper P, P, the control portion 50 may control the image forming portion 10 or the like to form the decision registration marks 12U between the jobs.

Further, the control portion 50 may calculate an average value of the detection widths of the respective decision registration marks formed on the intermediate transfer belt 8 plural times and is configured to decide whether or not the color registration correction carries out based on the calculated average value. This enables any suddenly generated color shifts to be avoided, which allows the control portion 50 to more surely determine whether or not the color registration correction carries out.

The invention claimed is:

1. An image forming apparatus which forms a color image by transferring images of respective colors formed on photosensitive members to an intermediate transfer member, the apparatus comprising:

an image forming portion that forms a decision mark for deciding whether or not a color registration correction for correcting color shifts in the color image carries out, the decision mark being obtained by registering the respective color marks on the intermediate transfer member such that when color shifts do not occur the respective color marks are each formed at a same position on the intermediate transfer member;

a detection portion that detects a width of the decision mark formed on the intermediate transfer member by the image forming portion; and a control portion that is configured to decide whether or not the color registration correction carries out based on the width of the decision mark detected by the detection portion; wherein the image forming portion forms plural decision marks on the intermediate transfer member and the control portion controls the image forming portion to change the frequency of forming the decision marks based on a variation amount in the widths of respective decision marks.

2. The image forming apparatus according to claim 1 wherein the control portion controls the image forming portion to set writing timings of the respective color marks so that the decision mark is formed on the intermediate transfer member between sheets of paper.

3. The image forming apparatus according to claim 1 wherein a timing of forming the decision mark is changeable.

4. The image forming apparatus according to claim 1 wherein the image forming portion contains plural photosensitive members corresponding to the respective colors; and the control portion controls the image forming portion to form the decision mark on the intermediate transfer member by using two photosensitive members which are set on positions that are farthest from each other among the plural photosensitive members.

5. The image forming apparatus according to claim 1 wherein the control portion controls the image forming portion to form the decision mark on the intermediate transfer member during a printing operation in a job; and when it is decided that the color shifts occur in the decision mark, the control portion controls the image forming portion to stop the printing operation in the job and start the color registration correction.

6. The image forming apparatus according to claim 1 wherein the control portion controls the image forming portion to change timing of forming the decision mark based on a length of a width of the decision mark detected by the detection portion.

7. The image forming apparatus according to claim 1 wherein the control portion is configured to decide whether or not the color registration correction is carried out by using a reference width of the decision mark that is a reference when the color shifts occur in the color image.

8. The image forming apparatus according to claim 1 wherein the control portion controls the image forming portion to set writing timing of the respective color marks so that the decision mark is formed on the intermediate transfer member between jobs.

9. The image forming apparatus according to claim 1 wherein the control portion calculates an average value of the widths of respective decision marks formed on the intermediate transfer member by plural times and is configured to decide whether or not the color registration correction carries out based on the calculated average value.

* * * * *